US010595685B2

(12) United States Patent
Falcon et al.

(10) Patent No.: US 10,595,685 B2
(45) Date of Patent: Mar. 24, 2020

(54) PUMPS, DISPENSERS AND METHODS OF USING THE SAME

(71) Applicant: Silgan Dispensing Systems Corporation, Grandview, MO (US)

(72) Inventors: Sara D. Falcon, Richmond, VA (US); Kelly A. Harrigan, Richmond, VA (US); Steven L. Sweeton, Lake Winnebago, MO (US); Niels F. G. Van Wieringen, GL's-Hertogenbosch (NL)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 15/570,440

(22) PCT Filed: Apr. 26, 2016

(86) PCT No.: PCT/US2016/029284
§ 371 (c)(1),
(2) Date: Oct. 30, 2017

(87) PCT Pub. No.: WO2016/176165
PCT Pub. Date: Nov. 3, 2016

(65) Prior Publication Data

US 2018/0153352 A1 Jun. 7, 2018

Related U.S. Application Data

(60) Provisional application No. 62/155,008, filed on Apr. 30, 2015.

(51) Int. Cl.
*B05B 11/00* (2006.01)
*A47K 5/12* (2006.01)
(Continued)

(52) U.S. Cl.
CPC ..... *A47K 5/1201* (2013.01); *B05B 11/00416* (2018.08); *B05B 11/02* (2013.01);
(Continued)

(58) Field of Classification Search
CPC ..... B05B 11/3059; B05B 11/0027; B05B 11/3008; B05B 11/0037; B05B 11/00416; B05B 11/02; B05B 11/06; B05B 11/061; B05B 11/3052; B05B 11/3056; B05B 11/0059; B05B 11/3005; B65D 83/205; B65D 83/22; B65D 83/20; B65D 83/56; B65D 2215/04; B65D 2215/02
(Continued)

(56) References Cited

U.S. PATENT DOCUMENTS 2,069,156 A * 1/1937 Bernhardt ..... B05B 11/0032 222/321.3
2,706,660 A * 4/1955 Johnson ..... B65D 83/14 222/108
(Continued)

FOREIGN PATENT DOCUMENTS

WO 2005005058 A1 1/2005

*Primary Examiner* — Charles Cheyney
(74) *Attorney, Agent, or Firm* — Barlow Josephs and Holmes Ltd; Stephen Holmes

(57) ABSTRACT

Pumps and dispensers having dosage control and various methods for actuating a pump or piston allow users to deliver a product from a container to be used by the user.

3 Claims, 11 Drawing Sheets

(51) Int. Cl.
*B05B 11/02* (2006.01)
*B05B 11/06* (2006.01)

(52) U.S. Cl.
CPC ..... *B05B 11/06* (2013.01); *B05B 11/061* (2013.01); *B05B 11/3052* (2013.01); *B05B 11/3056* (2013.01); *B05B 11/3059* (2013.01); *B05B 11/0059* (2013.01); *B05B 11/3005* (2013.01)

(58) Field of Classification Search
USPC ..... 222/321.8, 321.7, 401, 505, 309, 402.11, 222/153.13, 384, 402.13, 321.9; 401/11
See application file for complete search history.

(56) References Cited

U.S. PATENT DOCUMENTS 3,249,260 A * 5/1966 Goldberg ..... B65D 83/205 222/153.1
3,276,641 A * 10/1966 Lehmann ..... B67D 7/0211 222/526
3,426,948 A * 2/1969 Stirling ..... B65D 83/205 222/402.11
3,474,939 A * 10/1969 O'Donnell ..... B65D 83/205 222/320
3,608,791 A * 9/1971 Jordan ..... B65D 83/205 222/402.11
4,065,036 A * 12/1977 Kirk, Jr. ..... B05B 11/3059 222/153.13
4,589,574 A 5/1986 Foster
4,889,262 A * 12/1989 Toms ..... B05B 11/3059 222/153.13
5,363,992 A * 11/1994 Meshberg ..... B05B 1/1645 222/153.13
6,164,498 A 12/2000 Faughey et al.
6,543,649 B1 * 4/2003 Danielo ..... B05B 11/3059 222/153.13
D507,753 S * 7/2005 Lamb ..... D9/504
6,932,244 B2 * 8/2005 Meshberg ..... B05B 11/0032 222/153.13
8,308,029 B2 * 11/2012 Ki ..... B05B 11/0027 222/309
8,608,031 B2 * 12/2013 Lasserre ..... B05B 11/3059 222/153.13
9,010,581 B2 * 4/2015 Presche ..... B05B 11/0032 222/153.13
9,789,502 B2 * 10/2017 Maddy ..... B05B 15/30
2005/0072808 A1 4/2005 Kitamura
2011/0289890 A1 * 12/2011 Floyd ..... B65D 83/205 53/492
2013/0026186 A1 * 1/2013 Jenkins ..... B05B 11/0048 222/153.13

* cited by examiner

PUMPS, DISPENSERS AND METHODS OF USING THE SAME

BACKGROUND OF THE INVENTION

Field of the Invention

Embodiments of the invention relate to the pumps and dispensers for delivering fluid products and more particularly to pumps with adjustable dosing capabilities, pumps for inverted dispensing, and dispensers for delivering product to a surface to be used.

State of the Art

Pumps and dispensers are commonly used to deliver or distribute fluid or pasty products for use by a user. For example, pumps and dispensers may be used to deliver products typically sold in the beauty and personal care market segments, such as shampoo, soap, make-up, and other products. While numerous pumps and dispensers exist, users and brand owners are continually looking for improvements in such devices to improve the user experience or to enhance the features of a pump or dispenser.

BRIEF SUMMARY OF THE INVENTION

According to various embodiments of the invention, a pump device may include a simple dosing control system. The pump device may include a pump head and a collar. The collar may include steps such that the steps limit the stroke of the pump head and thus limit the amount of product pumped through the pump device per stroke of the pump head. In some embodiments of the invention, the collar may include two dosing configurations. In other embodiments, the collar may include any number of dosing configurations as desired.

According to other embodiments of the invention, a pump device may include an applicator or pump head for delivering a product in downward, onto a surface or into the palm of a user's hand. The pump device may include a mechanism for triggering a pump when the pump device is pushed onto a surface or a user's hand or body; when triggered, the pump may deliver a dose to the surface or user adjacent the position of the pump device.

According to still other embodiments of the invention, a pump device may include a pump that is actuated to fill a reservoir within a pump head of the pump device.

In still other embodiments of the invention, a dispenser may include a reservoir that is filled by an action of a user. The reservoir may be filled, for example, by twisting a ring to actuate a pump or move a piston which in turn delivers product into a reservoir for use by a user. In other embodiments, a pump may be actuated to deliver product into a reservoir. In still other embodiments, a pump may be actuated to move a piston and thereby move a product such that it can be delivered to a reservoir for use.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
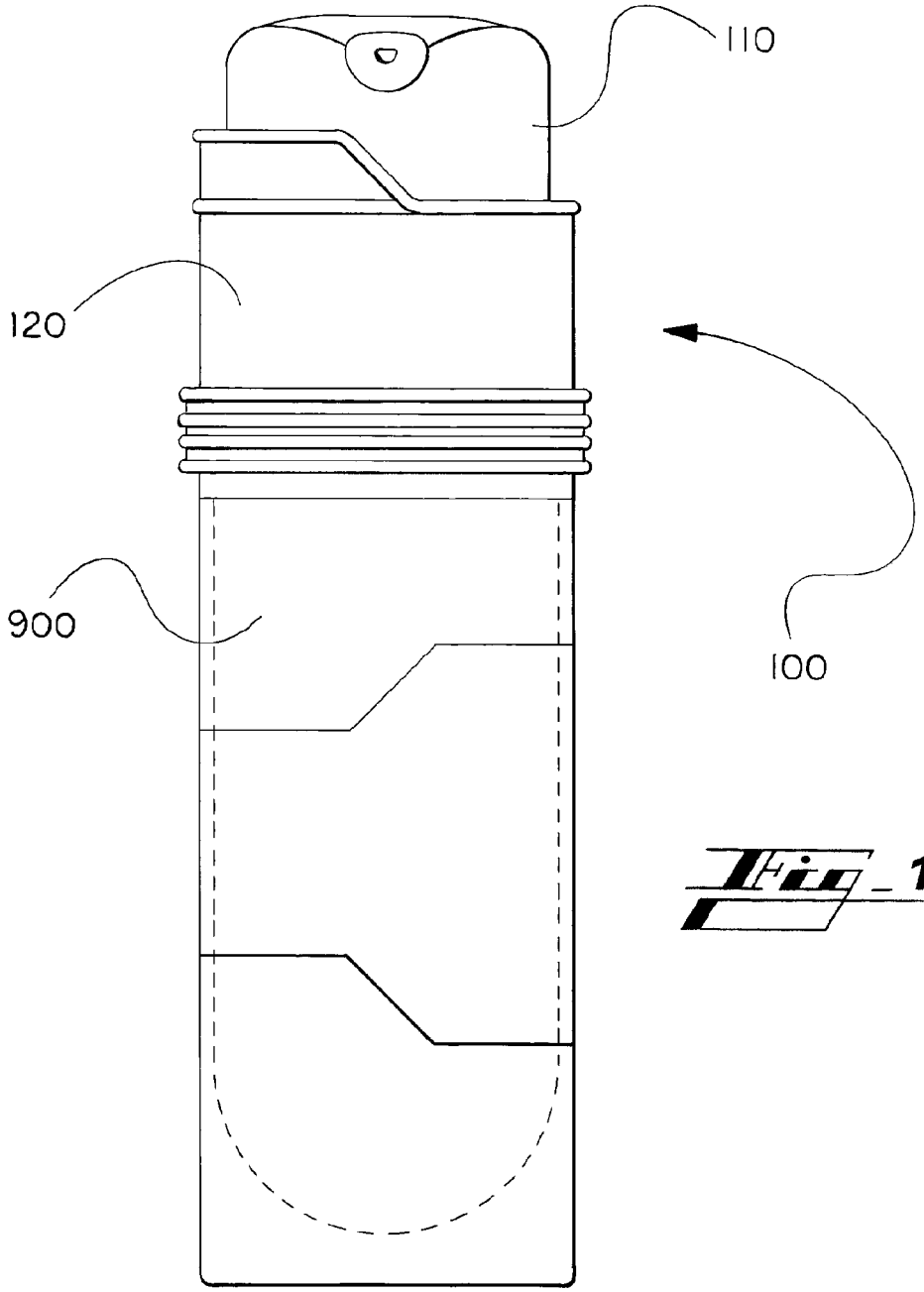
FIG. 1 illustrates a pump according to various embodiments of the invention.

According to various embodiments of the invention, a pump device 100 may include a pump having conventional features and parts attached to a pump head 110 for the delivery of a product through the pump head 110. The pump and pump head 110 may be attached to a container 900 and the attachment may include a collar 120 or chaplet. The collar 120 may include two or more levels or heights such that the height of the collar 120 may restrict the movement of the pump head 110 during actuation, thereby allowing multiple dosing options using the pump device 100 depending on the positioning of the pump head 110 relative to the collar 120.

Examples of a pump device 100 according to various embodiments of the invention are illustrated in FIGS. 1 through 7. As illustrated in FIGS. 1 through 4, a pump device 100 may include a pump head 110 mounted on a container 900, the pump head 110 having a collar 120 associated therewith. The collar 120—as illustrated—may include two or more levels or stages as illustrated in FIGS. 1 through 4. A first stage or level may be closer to the container 900 relative to a second stage or level. For instance, in some embodiments of the invention, a collar 120 may have a top surface which is circumferential in nature. The top surface may include a first level having a flat portion or level portion in a first plane. Sloping ramps associated with the top surface may slope upwards from the first level to a second level having a flat portion or level portion in a second plane. The pump head 110 may include a spout or other feature that may interact with the top surface of the collar 120 to restrict movement of the pump head 110.

Figure 2:
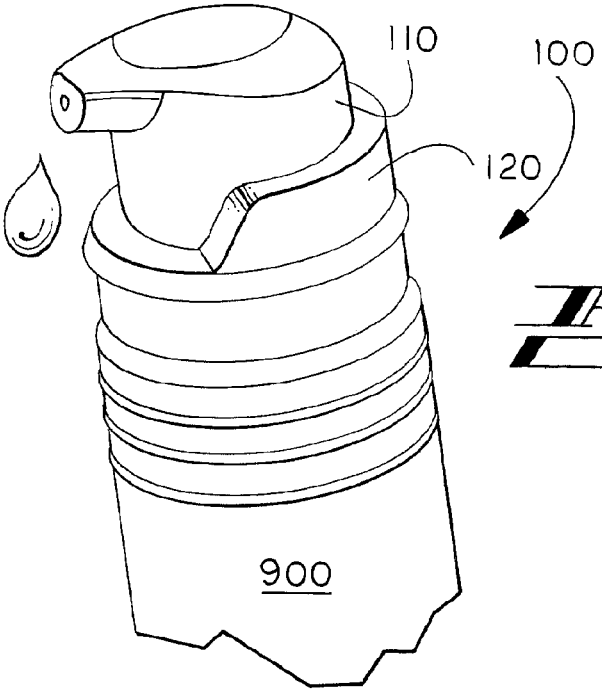
FIG. 2 illustrates a pump according to various embodiments of the invention.
Figure 3:
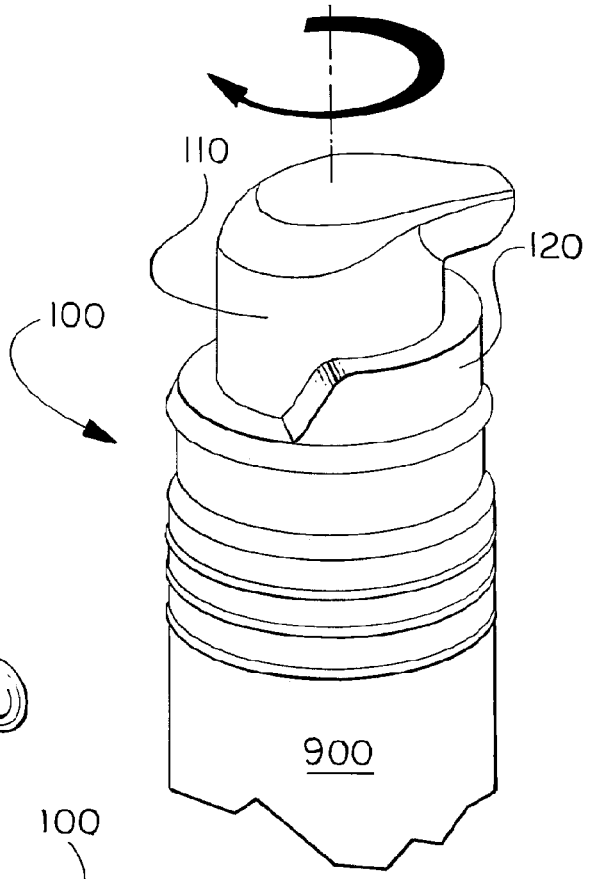
FIG. 3 illustrates a pump according to various embodiments of the invention.
Figure 4:
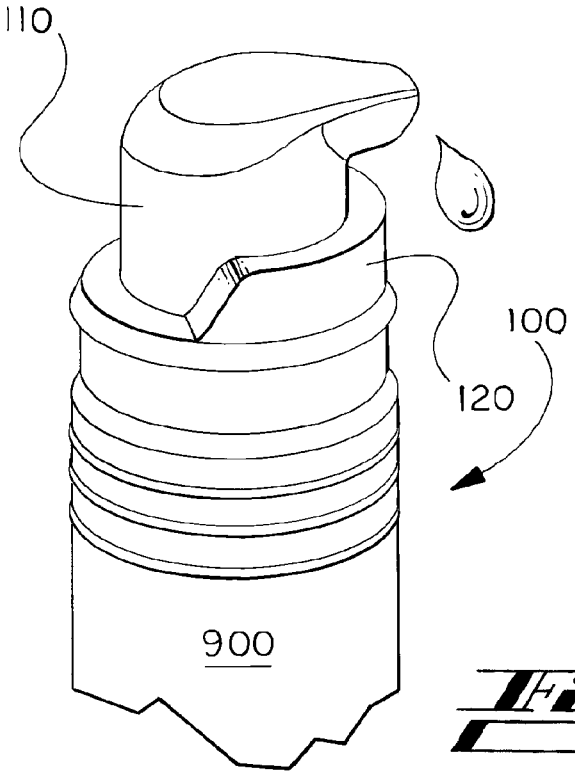
FIG. 4 illustrates a pump according to various embodiments of the invention.

In a first position—as illustrated in FIG. 2—the pump head 110 interacts with the first level—or lower level—of the collar 120 such that the stroke of the pump head 110 is maximized, producing a first dose of product through the pump head 110. Rotation of the pump head 110 as illustrated in FIG. 3 to position the spout of the pump head 110 over the second level of the top surface of the collar 120 as illustrated in FIG. 4 results in a restricted movement of the pump head 110 relative to the collar 120 as compared to the movement illustrated in FIG. 2. When the pump head 110 is actuated in FIG. 4, a second, smaller dose of product is delivered through the pump head 110 because the stroke length of the pump is minimized or restricted by the interaction of the pump head 110 with the collar 120. Thus, the pump device 100 illustrated in FIGS. 1 through 4 may be used to deliver two different dosages of product to a user.

Figure 5:
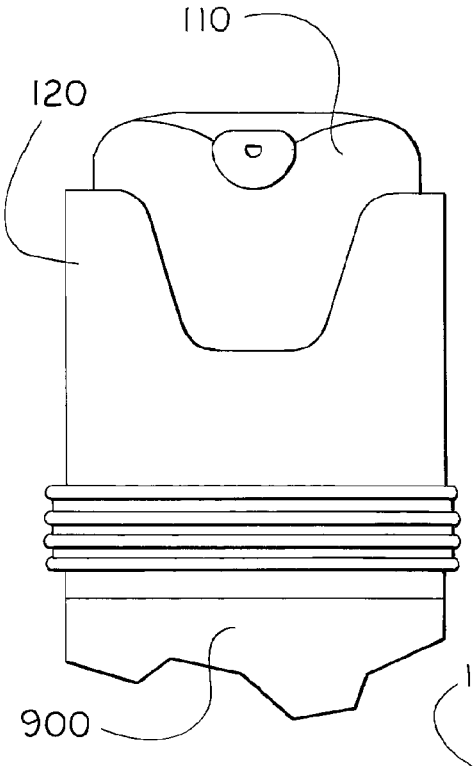
FIG. 5 illustrates a pump according to various embodiments of the invention.
Figure 6:
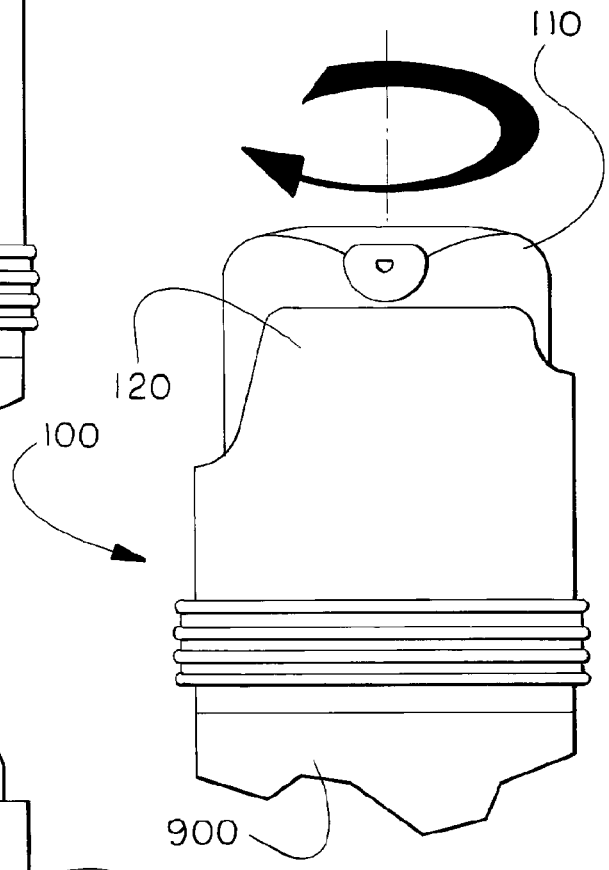
FIG. 6 illustrates a pump according to various embodiments of the invention.
Figure 7:
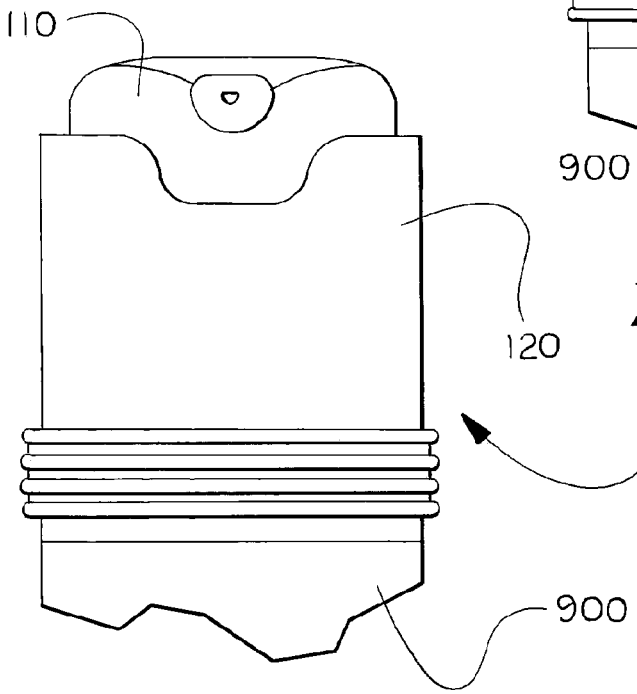
FIG. 7 illustrates a pump according to various embodiments of the invention.

According to other embodiments of the invention, a pump device 100 may include a collar 120 having different cutouts, valleys, or depressions to limit or control movement of the pump head 110 and dosing from the pump device 100. For example, as illustrated in FIGS. 5 through 7, a pump device 100 may include a pump having a pump head 110 and a collar 120 attached to a container 900. The collar 120 may include one or more depressions in a top surface of the collar 120 such that each depression allows the pump head 110 to move a different distance, thereby altering the stroke length of the pump head 110 and the amount of product delivered through the pump head 110 upon actuation. For instance, actuation of the pump head 110 illustrated in FIG. 5 produces a long stroke of the pump head 110 such that a first dose of product is delivered. Rotation of the pump head 110 as illustrated in FIG. 6 into the pump head 110 position illustrated in FIG. 7 moves the pump head 110 into position relative to a shorter depression in the collar 120. Actuation of the pump head 110 in the position shown in FIG. 7 produces a second, smaller dose of product through the pump head 110 because the movement of the pump head 110 relative to the collar 120 is shortened by the interaction of the pump head 110 with the collar 120.

While the pump devices 100 illustrated in FIGS. 1 through 7 include collars 120 that restrict the movement of a pump head 110 to control the dose of product delivered, other embodiments of the invention may utilize the collar 120 configurations illustrated in FIGS. 1 through 7 as visual cues to inform a user of the various dosages that may be obtained when the pump heads 110 are moved relative to the collars 120. The restriction of movement of the pump heads 110 in such embodiments may not be due to the collar 120 or collar 120 height. Instead, in some embodiments of the invention, posts, stroke blocking features, or other features may be incorporated within the pump device 100 or associated pump used with the pump head 110 and collar 120 such that those features actually restrict the movement of the pump head 110 while the collar 120 positioning only provides a visual cue to the user about the dosage selected for the pump device 100.

Figure 8:
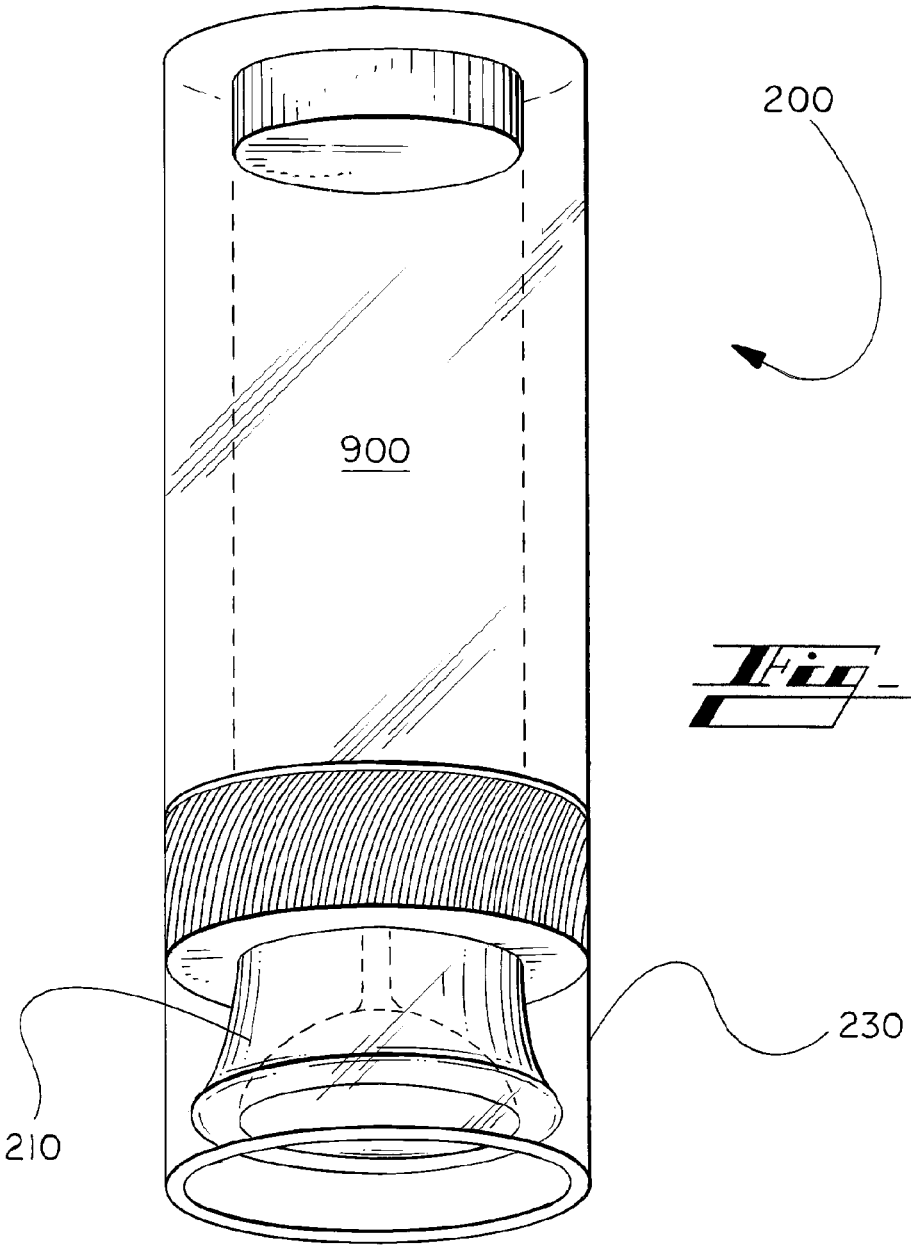
FIG. 8 illustrates a pump according to various embodiments of the invention.
Figure 9:
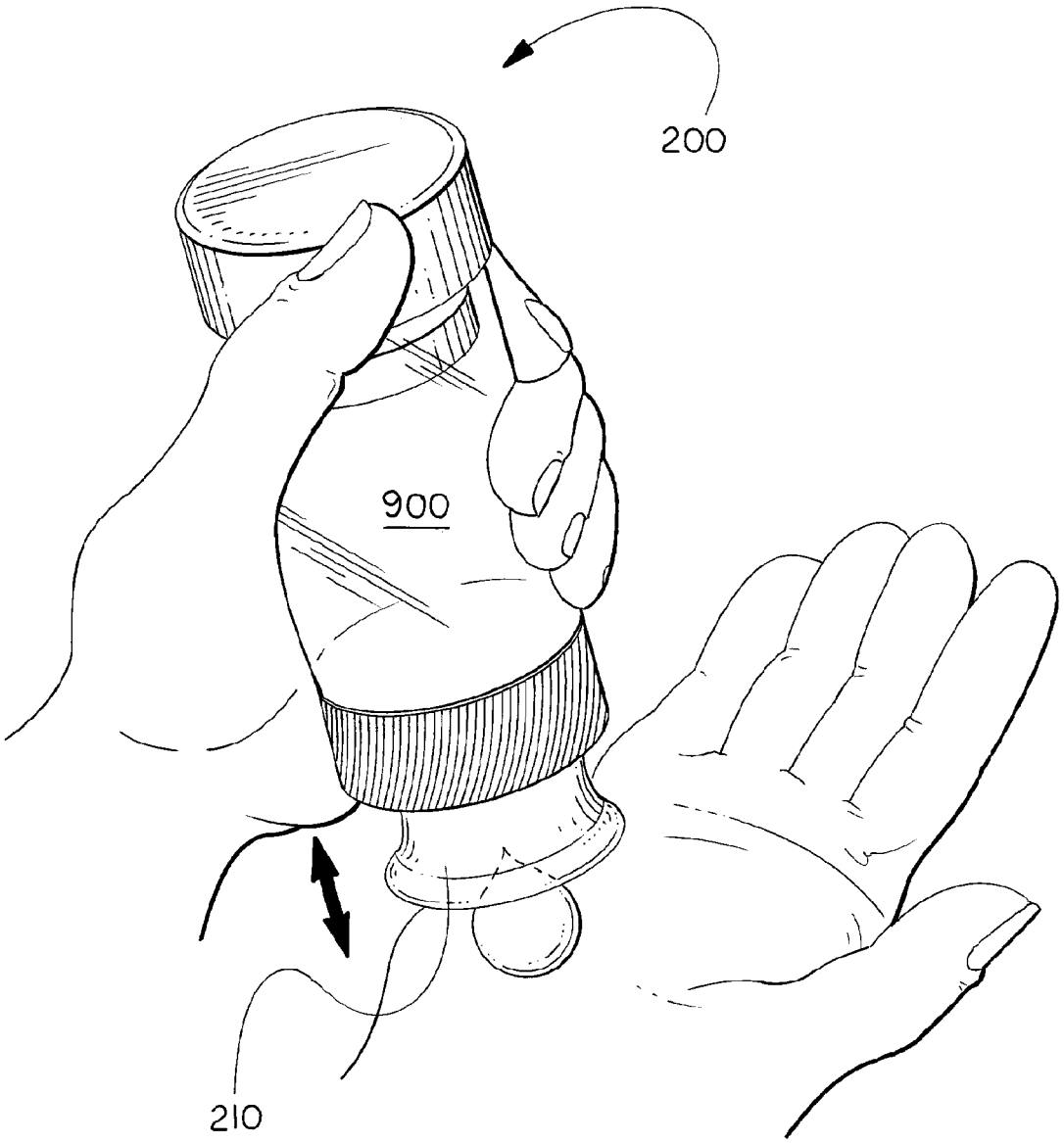
FIG. 9 illustrates a pump according to various embodiments of the invention.

A pump device 100 according to still other embodiments of the invention is illustrated in FIGS. 8 and 9. As illustrated, the pump device 200 may include a pump head 210. In some embodiments the pump device 200 may also include a pump actuator 230. The pump device 200 may also include a container 900 having a product therein as illustrated.

According to some embodiments of the invention, a pump device 200 may be actuated by applying a force to the pump actuator 230. As a force is applied to the pump actuator 230, the pump actuator 230 moves, resulting in the pumping of product to the pump head 210. As illustrated in FIG. 8, the pump device 200 is intended to be used in a position where the pump head 210 is pointed downward or at a surface onto which the product is desired. For instance, a user may pick up the pump device 200 as illustrated in FIG. 9 and push the pump actuator 230 against their palm such that product is delivered to the pump head 210 and onto the user's palm.

In other embodiments of the invention, the pump device 200 may not include a pump actuator 230. Instead, the pump head 210 may act as an actuator and the pump head 210 may be moved to actuate a pump associated with the pump device 200 and deliver product to the pump head 210 as illustrated in FIG. 9.

Figure 10:
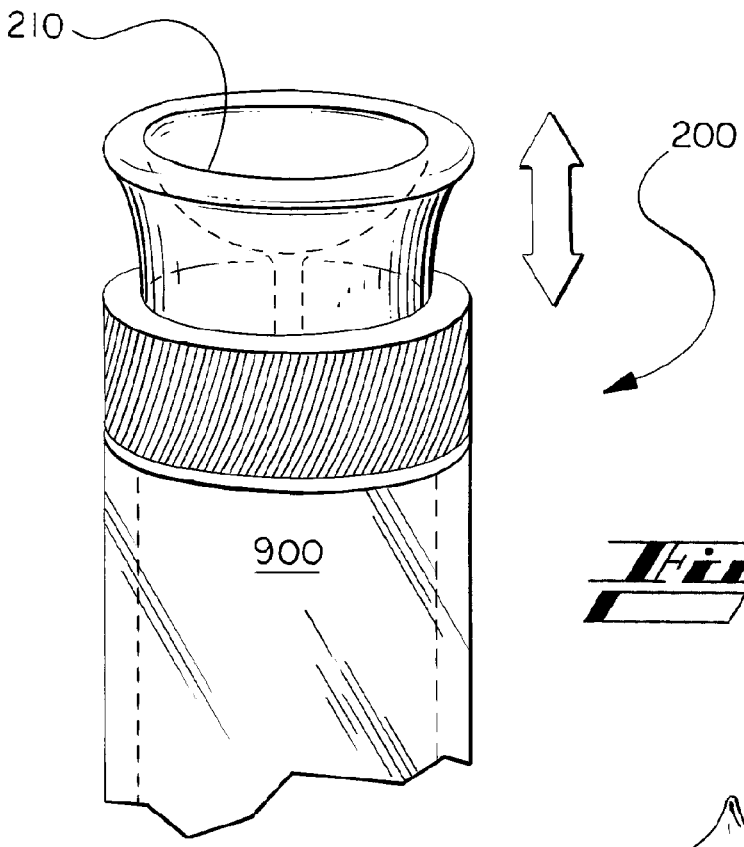
FIG. 10 illustrates a pump according to various embodiments of the invention.
Figure 11:
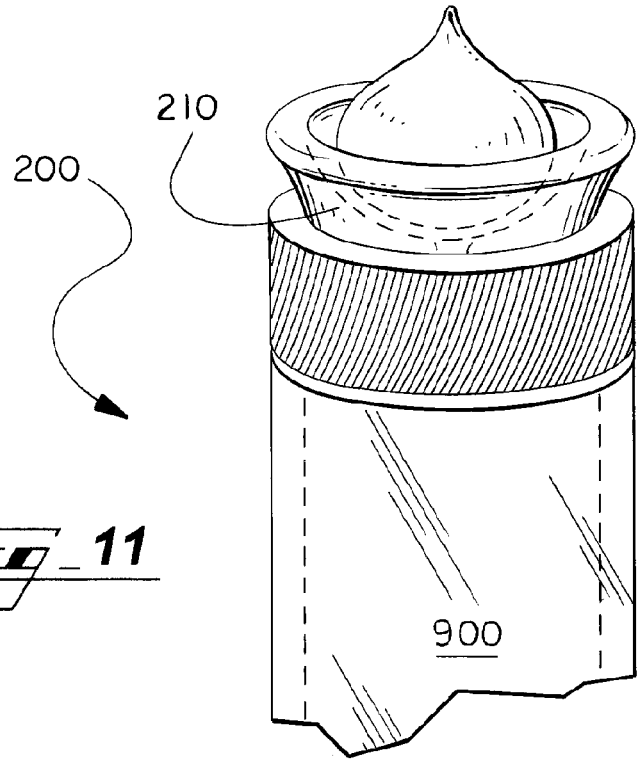
FIG. 11 illustrates a pump according to various embodiments of the invention.

According to still other embodiments of the invention, a pump device 200 may be used in an upright position as illustrated in FIGS. 10 and 11. As illustrated in FIG. 10, the pump head 210 may be actuated up and down to disperse a product into a reservoir 212 in the pump head 210. Upon actuation, a product is delivered to the reservoir 212 as illustrated in FIG. 11.

Figure 12:
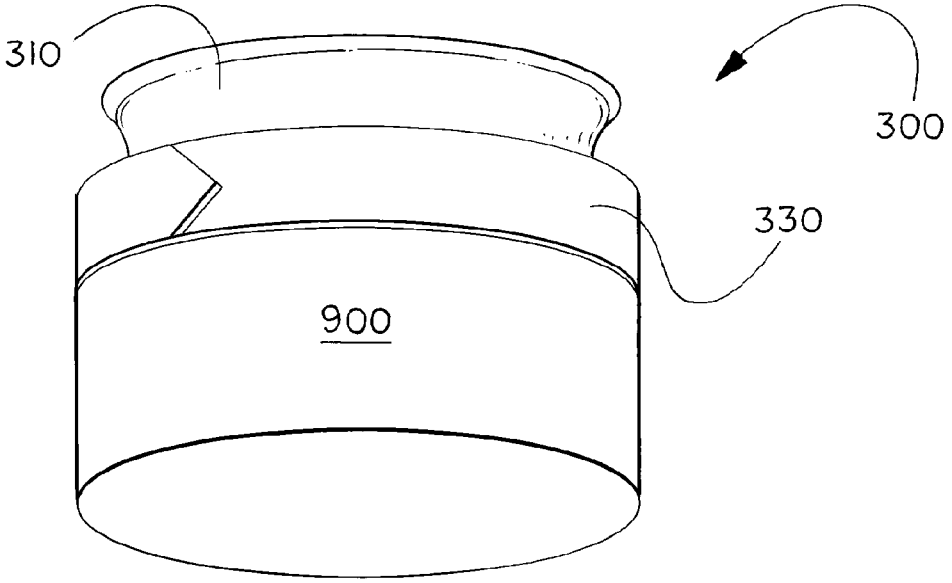
FIG. 12 illustrates a dispenser according to various embodiments of the invention.
Figure 13:
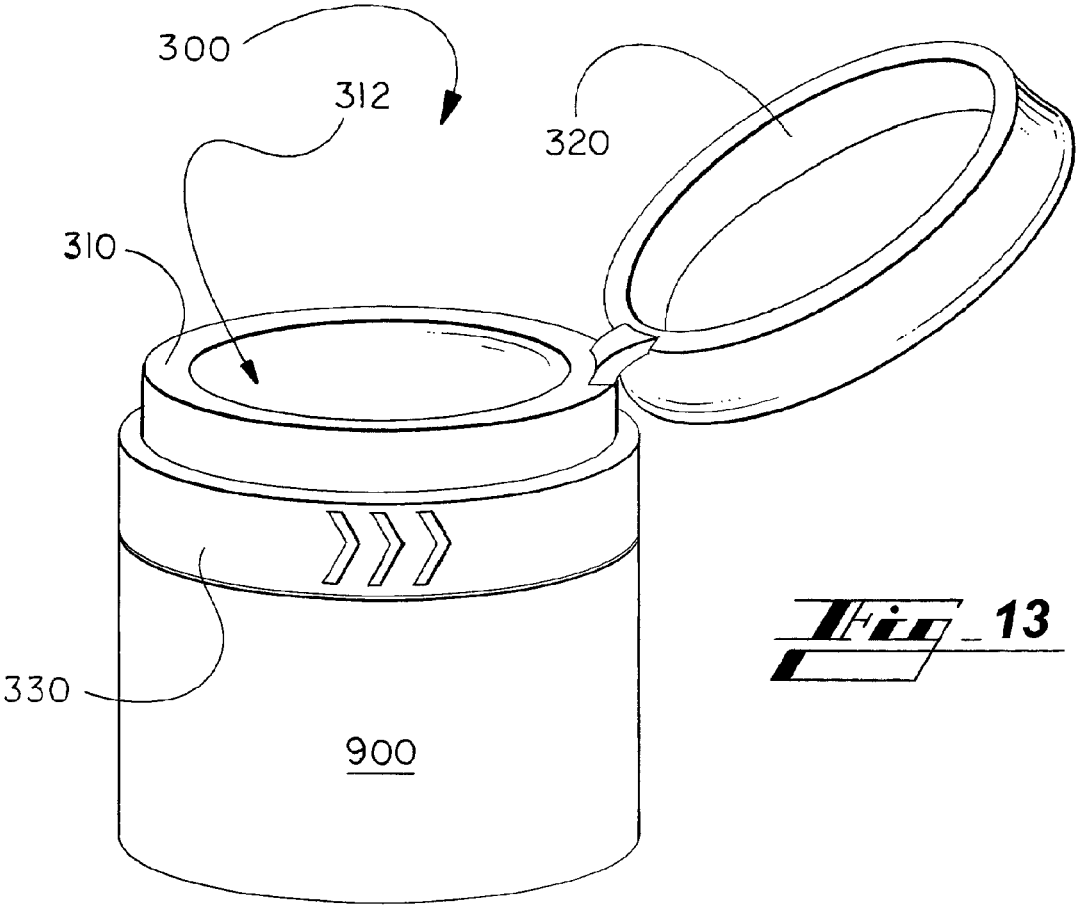
FIG. 13 illustrates a dispenser according to various embodiments of the invention.
Figure 14:
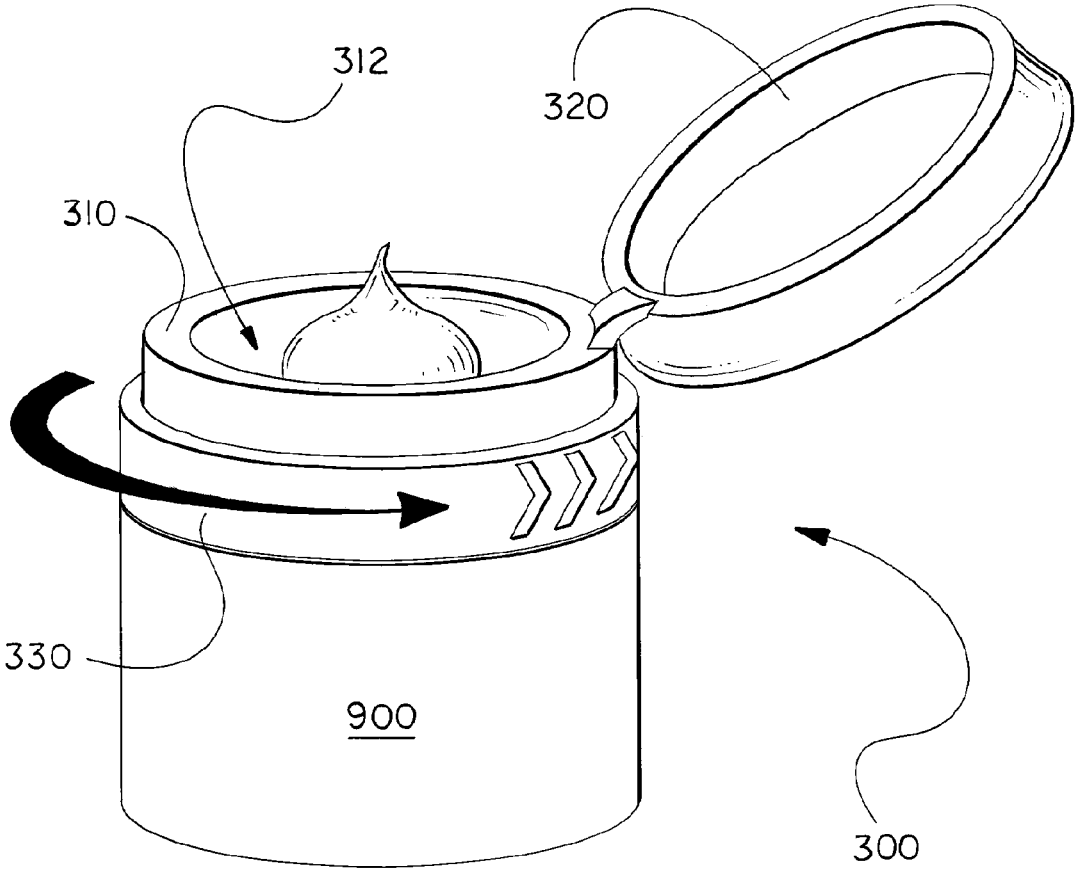
FIG. 14 illustrates a dispenser according to various embodiments of the invention.

A dispenser 300 according to various embodiments of the invention is illustrated in FIGS. 12 through 14. As illustrated, a dispenser 300 may include a container 900, an actuation device 330 and a dispensing head 310. The dispenser 300 may also include a cap 320 or cover in some embodiments of the invention.

As illustrated in FIGS. 12 through 14, an actuation device 330 may include a ring about or associated with the dispenser 300 wherein the ring may be rotated with respect to the container 900, the dispensing head 310, or both the container 900 and the dispensing head 310. As the ring or actuation device 330 is rotated, product is dispensed from the container into the dispensing head 310. In some embodiments, the dispensing head 310 may include a reservoir 312 into which the product is dispensed as illustrated in FIG. 14.

According to various embodiments of the invention, a dispenser 300 may be used to deliver a beauty care product to a user. In some such instances, the product stored in the dispenser 300 may be very valuable or may be sensitive to oxygen exposure. Thus, in some embodiments of the invention, a cap 320 or cover may be associated with the dispenser 300. The cap 320 or cover may provide a hermetic seal with the dispensing head 310 such as to help preserve a product in the container 900 when the dispenser 300 is not in use.

According to certain embodiments of the invention, rotation of the actuation device 330 moves a piston within the container 900 to push product into the dispensing head 310. In other embodiments of the invention, rotation of the actuation device 330 actuates a pump which pumps product into the dispensing head 310.

Figure 15:
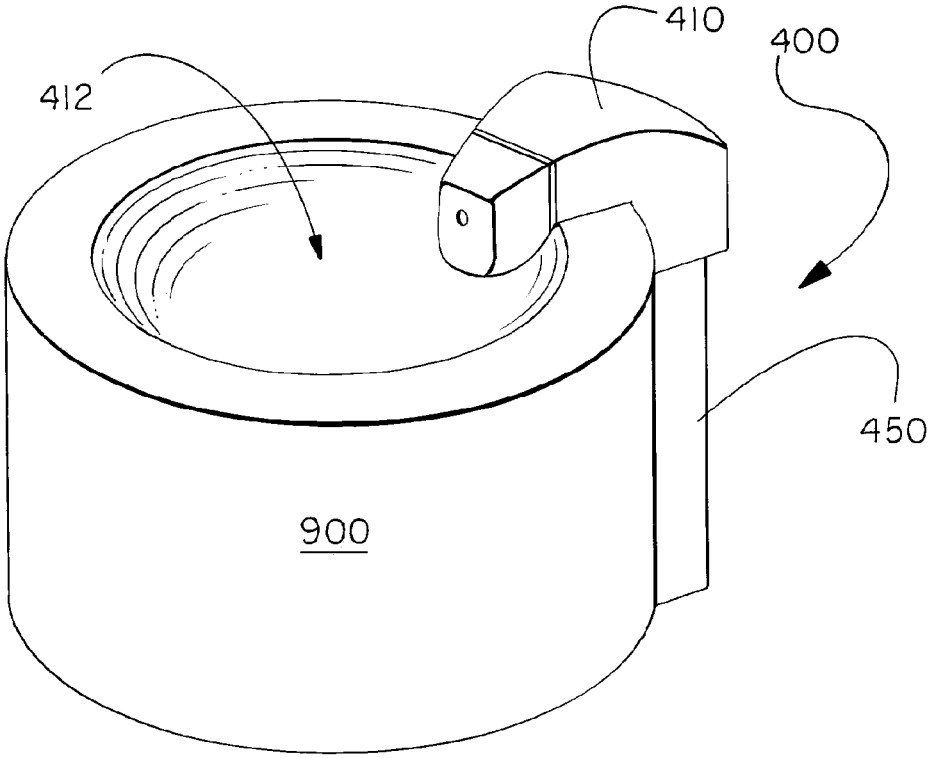
FIG. 15 illustrates a dispenser according to various embodiments of the invention.
Figure 16:
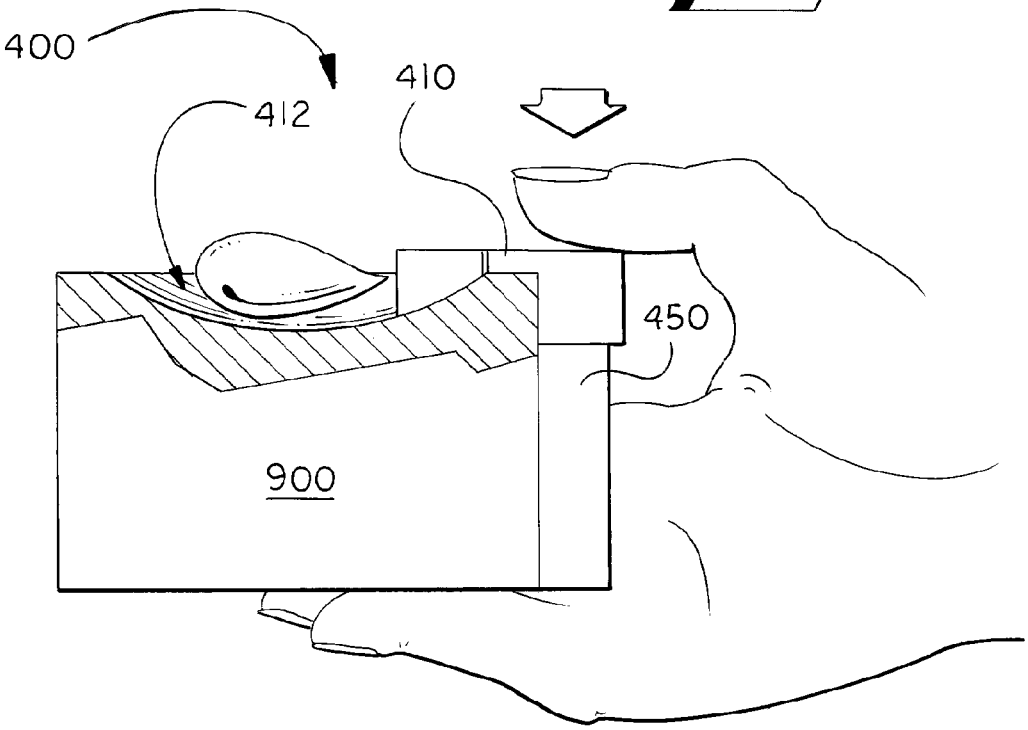
FIG. 16 illustrates a dispenser according to various embodiments of the invention.

A dispenser 400 according to other embodiments of the invention is illustrated in FIGS. 15 and 16. As illustrated, the dispenser 400 may include a container 900 and a pump device 450 associated therewith. The pump device 450 may be a part of or integrated with the container 900 or may be an attachment capable of being coupled to any desired number of containers 900. For example, the pump device 450 may include a spike or connector configured to mate with a container 900 such that the pump device 450 may be used with multiple refill containers before being disposed of.

According to certain embodiments of the invention, the pump device 450 may include a pump head 410 associated with a pump mechanism that is in fluid communication with a product in the container 900. As the pump head 410 is actuated as illustrated in FIG. 16, a product is pumped from an interior of the container 900 into a reservoir 412 in a top of the container 900 or container shell such that a user may scoop the product out of the reservoir 412.

Figure 17:
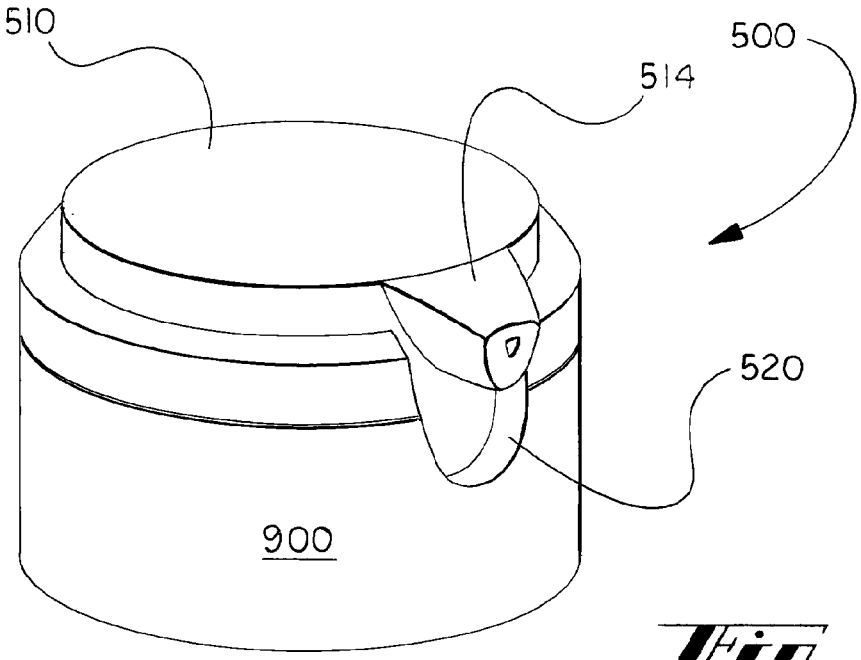
FIG. 17 illustrates a dispenser according to various embodiments of the invention.
Figure 18:
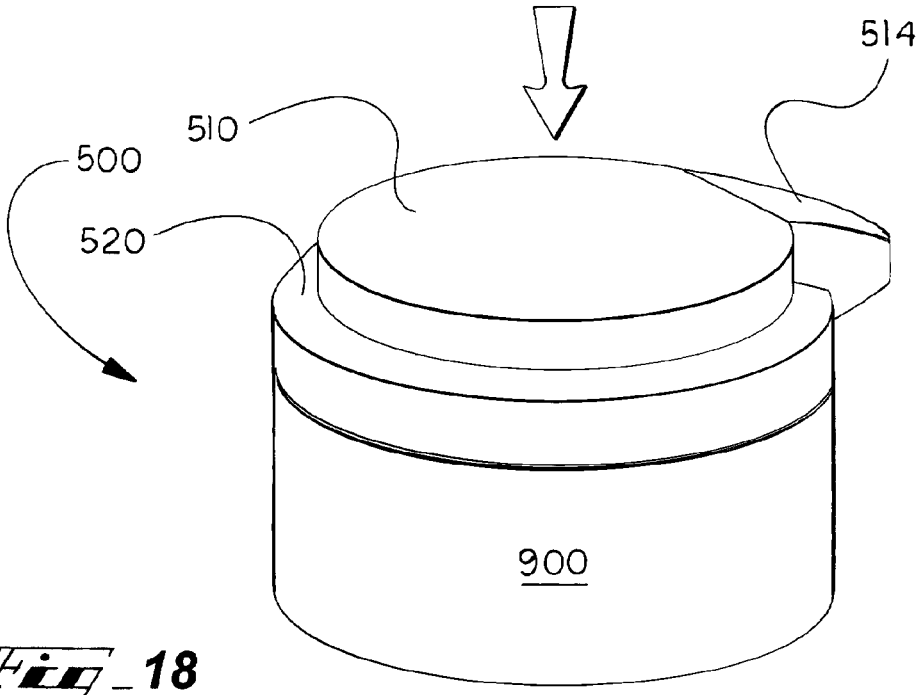
FIG. 18 illustrates a dispenser according to various embodiments of the invention.

A dispenser 500 according to other embodiments of the invention is illustrated in FIGS. 17 and 18. As illustrated, a dispenser 500 may include a container 900. A collar 520 may be associated with the container 900, may be a part of the container 900, or may be part of a shell that holds the container 900. The collar 520 may include one or more depressions into which a spout 514 of a pump head 510 may move during actuation of the pump head 510. For example, as illustrated in FIG. 17, a spout 514 of a pump head 510 may be associated with a depression in the collar 520 such that movement of the pump head 510 is allowed. As the pump head 510 is moved, a product is pumped from the container 900 and out the spout 514 of the pump head 510 to a user.

Figures 19, 20:
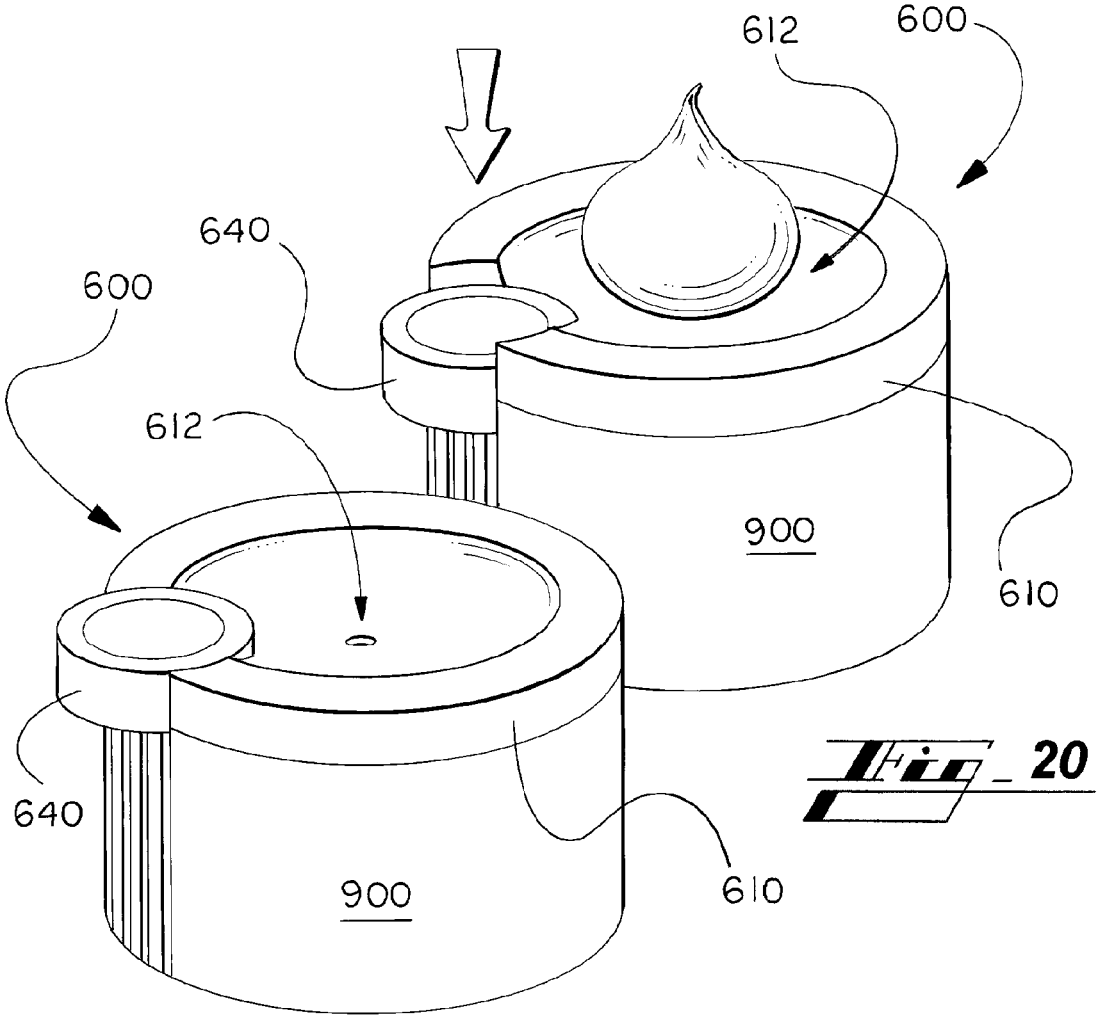
FIG. 19 illustrates a dispenser according to various embodiments of the invention.
FIG. 20 illustrates a dispenser according to various embodiments of the invention.

A dispenser 600 according to still other embodiments of the invention is illustrated in FIGS. 19 and 20. As illustrated, a dispenser 600 may include a container 900 holding a product, a dispenser head 610, and an actuator 640. The dispenser head 610 may include a reservoir 612 and an orifice through which product may be dispensed into the reservoir 612 or onto a portion of the dispenser head 610.

According to some embodiments of the invention, an actuator 640 may be depressed as illustrated in FIG. 20 to dispense a product from the container 900 into the reservoir 612 of the dispenser head 610. In some embodiments of the invention, depression or actuation of the actuator 640 may actuate a pump associated with the dispenser 600 to dispense the product into the reservoir 612. According to other embodiments of the invention, actuation of the actuator 640 may pump air into an air chamber or into a chamber below a piston contained in the container 900. As air is pumped into the chamber, a piston, bag, or other device may push on the product to push the product through an orifice and into the reservoir 612.

According to various embodiments of the invention, the dispenser head 610 may include an orifice, a valved orifice, or a sealed orifice through which product may pass from the container onto the dispenser head 610. For instance, the orifice may include a silicon seal or other seal that will allow product to pass through onto the dispenser head 610 but which prevents air from returning into the container.

What is claimed is:

1. A pump device, comprising:

a container;

a pump associated with the container;

a pump head in fluid communication with the pump, the pump head including a radially extending spout;

a collar positioned between the container and the pump head, the collar comprising:

a top most surface;

an upper first level located at the bottom of a first valley extending downwardly from the top most surface, wherein the first valley includes opposing ramped surfaces extending axially downward from the top most surface, wherein the opposing ramped surfaces are sloped inwardly, and a lower second level located at the bottom of a second valley extending downwardly from the top most surface, wherein the second valley includes opposing ramped surfaces extending axially downward from the top most surface, wherein the opposing ramped surfaces are sloped inwardly, wherein the spout is configured to ride along and interact with the top most surface of the collar and to ride and interact with the opposing ramped surfaces, wherein the pump head may move a first distance when aligned with the first level of the collar and may move a second distance when aligned with the second level of the collar, and said pump head having a locked configuration wherein the pump head is prevented from moving the first distance or the second distance when the spout is disposed above and on the top most surface.

2. The pump device of claim 1, wherein the first valley and the second valley are disposed at different locations about the circumference of the collar such that the top surface extends therebetween.

3. The pump device of claim 1, wherein movement of the spout to the first level expels a first amount of material and movement of the spout to the second level expels a second amount of material.

* * * * *